US005612787A

United States Patent [19]

Harvey et al.

[11] Patent Number: 5,612,787

[45] Date of Patent: Mar. 18, 1997

[54] STRIATION MONITOR AND DISPLAY SYSTEM AND METHOD

[75] Inventors: William B. Harvey, Olney; Leonard S. Haynes, Rockville, both of Md.; Andrew J. Lavin, Washington, D.C.; Ramgopal Nair, Ellicott City, Md.

[73] Assignee: Mnemonic Systems Incorporated, Washington, D.C.

[21] Appl. No.: 464,959

[22] Filed: Jun. 5, 1995

[51] Int. Cl.[6] ..... G06F 15/20

[52] U.S. Cl. ..... 356/388; 356/426

[58] Field of Search ..... 356/394, 398, 356/388, 426

[56] References Cited

U.S. PATENT DOCUMENTS 4,360,274 11/1982 Norton-Wayne ..... 356/394
4,561,103 12/1985 Horiguchi et al. ..... 356/394
4,578,810 3/1986 MacFarlane et al. ..... 356/394
5,390,158 2/1995 Baldur et al. ..... 324/409

*Primary Examiner*—Richard A. Rosenberger
*Attorney, Agent, or Firm*—Morton J. Rosenberg; David I. Klein

[57] ABSTRACT

A striation monitor and display system (10) is provided which includes a positional location mechanism (20) for locating a substantially cylindrically contoured object such as a bullet (14). The bullet or object (14) is inserted within a collet mechanism (48) mounted above a cup member (44) containing a compliant matrix (46). A portion of the object (14) is inserted along an axis line (24) of the rotating cup (44). A line scan camera (62) is focused on a section of the object (14) and frame speed is synchronized with the rotation of the rotating cup (44). Synchronization is accomplished by a closed feedback loop between a motor/encoder integral combination (58/60) and a processor system (72) for maintaining synchronization between images photographed by line scan camera (62) and rotational speed of motor (58).

32 Claims, 3 Drawing Sheets

STRIATION MONITOR AND DISPLAY SYSTEM AND METHOD

BACKGROUND OF THE INVENTION

Field of the Invention

This invention pertains to systems for comparing, monitoring, and displaying striations with respect to at least a pair of cylindrically formed objects. In particular, this invention is directed to a striation display system whereby it may be determined whether striations on one cylindrically contoured object match the striations on a second cylindrically contoured object. More in particular, this invention relates to a striation monitor and display system where a determination may be made whether a particular gun has fired two bullets through a comparison of the striations formed within each of the bullets. Still further, this invention is directed to a striation monitor and display system where the object being displayed is rotated at a predetermined rotational speed about a vertically extending axis line and is imaged by a line scan camera which is focused to a particular section of the object being photographed. Additionally, this invention directs itself to a striation monitor and display system where the object being imaged is photographed at a predetermined image frame speed by a line scan camera which is synchronized to the object or bullet rotational speed. Still further, this invention directs itself to a striation monitor and display system whereby a line scan camera is triggered responsive to a set of pulses including an index pulse formed once at each rotation of the object being rotated and a predetermined number of encoder pulses which provide for a predetermined number of pulses per a singular rotation of the object being photographed. Still further, this invention directs itself to a striation monitor and display system where the images may be sent to a monitor such as a cathode ray tube or to a magnetic disc for storage of the data contained therein. Additionally, this invention relates to a striation monitor and display system where bullet fragments and cartridge cases may be linearly translated in opposition to a rotation in the line of sight of a line scan camera with resulting striation data being captured as in the case of the rotating cylindrical objects.

PRIOR ART

The matching of striations between two objects is known in the prior art. It has been possible to determine if an object or bullet has been fired from a particular gun by comparing the striations on a first bullet with the striations formed within a second bullet which is test fired from the gun. However, in the prior art of this procedure, such has required a manual microscopic examination of the scratches, or striations made by the gun on the bullets as they move through the gun barrel.

In some prior art systems for comparing the images from bullets, there has been used microscopes which involve a human operator to view the cylindrical sides of two bullets simultaneously through the same eyepieces. In such prior art systems, the bullets are rotated manually in an attempt to find a particular rotational angle at which the bullet striations match. Generally, striations on bullets fired from different guns will not cause a match to be made.

Even for bullets fired from the same gun, striations will only match at one single rotational angle of one bullet with respect to the other. In such prior art systems, only a small section of the bullets' surface are in focus under the microscopes at any one time which hinders attempts to find the correct rotational angle if in fact the bullets were fired from the same gun. Such prior art systems and methods are only statistical in nature rather than exact due to the fact that even when bullets are fired from the same gun and viewed at the correct rotational angles, they are not found to match exactly in every respect.

Prior art systems and methods using manual microscope methods as previously described are extremely time consuming and the use of such techniques to match or compare large numbers of bullets possibly recovered from crime scenes with large numbers of guns found in the possession of potential suspects is generally not feasible.

SUMMARY OF THE INVENTION

A striation monitor and display system is provided which includes a mechanism for positionally locating a substantially cylindrically contoured object. A releasable capturing mechanism is used for releasably capturing the positionally located object. A rotational mechanism is provided for rotating the object inserted within a compliant matrix. The object is rotated at a predetermined rotational speed about a vertically extending axis line of the object. A mechanism for photographing a portion of the object through a plurality of images of the rotating object along a vertical direction at a predetermined image frame speed is included within the overall system. The photographing image frame speed is synchronized with the predetermined object rotational speed and angular orientation with the image of the photographed object being displayed or stored. Additionally, a removable translating mechanism may be used to convert the rotational motion or displacement of the motor into linear translational motion of objects past a line scan camera for photographing non-cylindrical objects such as bullet fragments and cartridge cases.

DESCRIPTION OF THE PREFERRED EMBODIMENTS

Figure 2:
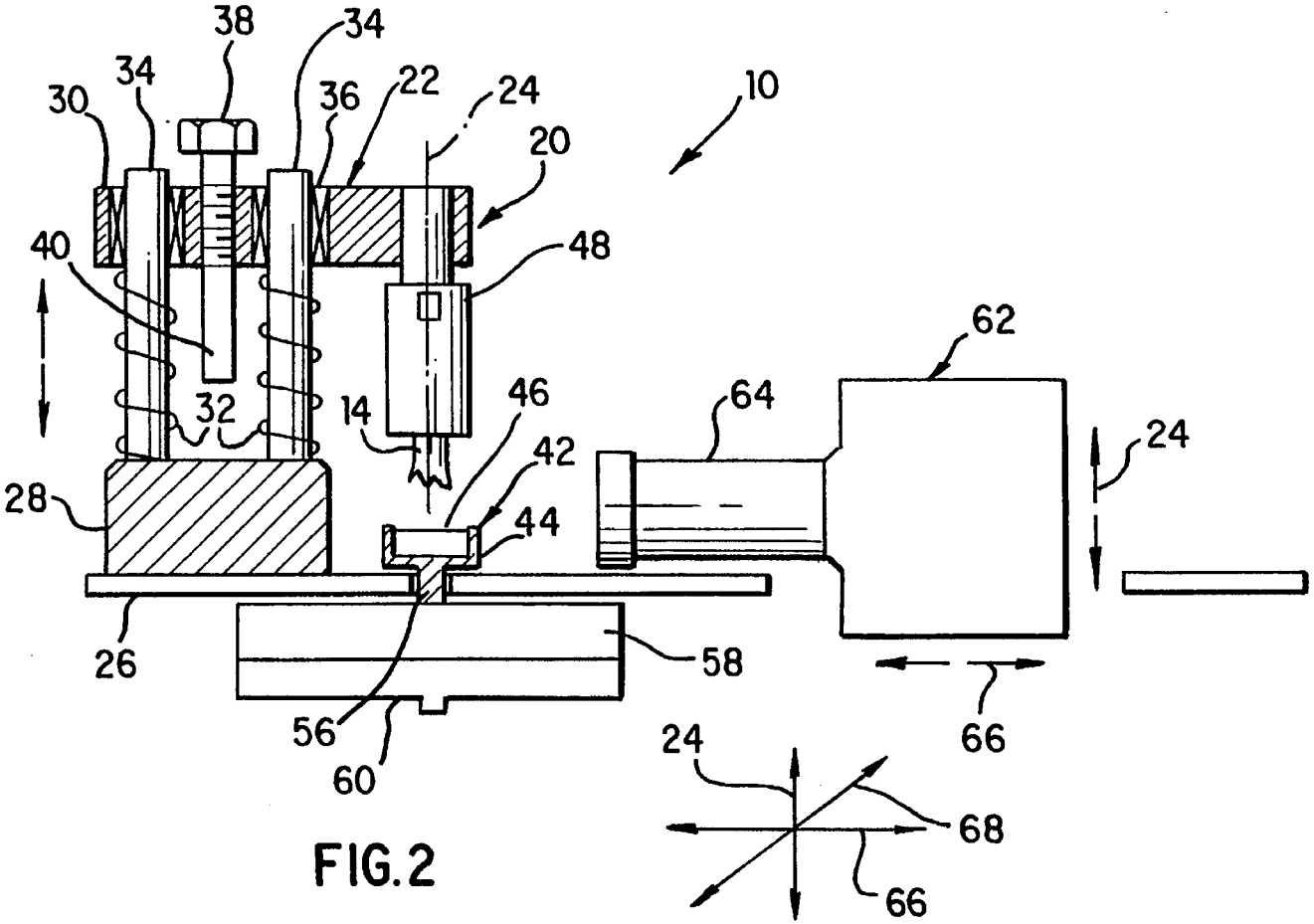
FIG. 2 is an elevational sectional block diagram view of the positional location and photographing mechanisms of the striation monitor and display system.
Figure 1:
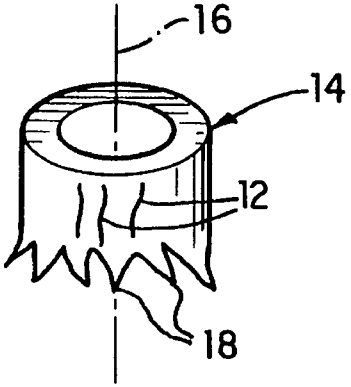
FIG. 1 is a perspective view of a cylindrically contoured object in the form of a shattered bullet.
Figure 3:
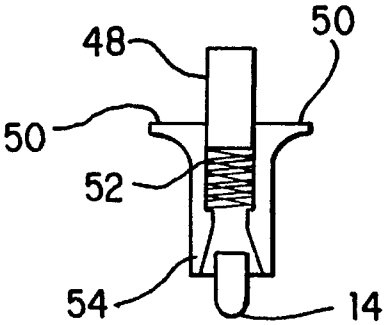
FIG. 3 is a sectional view of the collet member showing insert of a cylindrically contoured object.

Referring now to FIGS. 1–3, there is shown striation monitor and display system 10 for displaying and monitoring striations 12 formed within a substantially cylindrical contoured object 14 generally having a central axis 16 as is shown in FIG. 1. In general, striations 12 of one cylindrically contoured object or bullet 14 are to be compared with striations of a second bullet fired from the same gun to determine whether the striations 12 provide a match between the striations in order to determine if the gun used for firing both bullets is the same gun. Referring to FIG. 1, a used bullet 14 generally is misshapen at its end and contains shards 18 which makes the cylindrically contoured object or bullet 14 difficult to mount, as will be seen in following paragraphs.

Thus, in overall concept, striation monitor and display system 10 is used to compare striations 12 between one cylindrically contoured object or bullet 14 and a second bullet or cylindrically contoured object 14 to determine whether a match of striations 12 can be found. In the event that there is a match or comparison equivalency, it can be determined that the same gun fired the bullets 14 being compared. Through use of system 10, the time in displaying and comparing striations 12 between a pair of bullets 14 is optimized and provides increased accuracies in the determination of the comparison of the striations 12.

System 10 includes positional location mechanism 20 shown in FIG. 2 for positioning, and capturing mechanism 42 for maintaining cylindrically contoured object or bullet 14 in a relatively stationary positional location while allowing bullet 14 to be rotated about vertical axes 24 during the monitoring and display of striations 12. Object or bullet placement fixture 22 is used in combination with stationary table 26 and is mounted in fixed position thereto. Object or bullet placement fixture 22 includes fixture lower base member 28 secured to stationary table 26. Fixture lower base member 28 may be secured to stationary table 26 through bolts, or other threaded securement or even in the alternative may be releasably secured thereto, not important to the inventive concept with the exception that object or bullet placement fixture 22 be maintained in a fixed position with respect to stationary table 26 during particular positional placement of bullet or cylindrically contoured object 14 at the beginning of the procedure leading to the overall striation comparison.

Fixture upper base member 30 is vertically displaceable in a reversible manner with respect to fixture lower base member 28. As is seen in FIG. 2, fixture upper base member 30 may slide on a pair of vertically directed fixture rods 34 within bearings 36. Fixture upper base member 30 is biased away from fixture lower base member 28 by springs 32 surrounding vertically directed fixture rods 34. In this manner, fixture upper base member 30 may be moved vertically downward in vertical direction 24 and upon insert and capturing of cylindrically contoured object or bullet 14, may then be released and displaced vertically away from fixture lower base member 28 through spring biasing force.

Object or bullet placement fixture 22 further includes an optional stop mechanism 38 to terminate the downward displacement of fixture upper base member 30 with respect to fixture lower base member 28. In this manner a particular minimum displacement may be provided between fixture upper base member 30 and fixture lower base member 28 during placement of cylindrically contoured object or bullet 14. Optional stop mechanism 38 may be a bolt member which is threadedly secured as shown in FIG. 2, to fixture upper base member 30 and provides for a stop bolt lower section 40 extending below fixture upper base member 30. By threaded rotation of stop mechanism or bolt 38, lower bolt section 40 may be elongated or contracted with respect to a lower surface of fixture upper base member 30, thereby determining a minimum distance between upper and lower base members 30 and 28.

Striation monitoring display system 10 further includes capturing mechanism 42 for securely capturing bullet 14 during the monitoring and display of striations 12. Capturing mechanism 42 includes cup member 44 having a central axis coincident with vertical axis or vertical direction 24 passing through the central portion of bullet 14. Cup member 44 has contained therein matrix 46 formed of a compliant matrix for insert of cylindrically contoured object or bullet 14. In this manner, bullet 14 may be inserted into matrix 46 in a secure manner to allow object or bullet 14 to be rotated during the monitoring procedure. Beeswax has been successfully used as the compliant matrix 46 within cup member 44, however, other compliant matrices may be used for placement and securement of object 14 with the only criteria being that the composition of matrix 46 is of such a nature as to allow insertion and securement of bullet 14 therein during rotation about vertical axis 24.

Object placement fixture 22 of positional location mechanism 20 further includes collet 48 mounted to one end of fixture upper base member 30 as is shown in FIG. 2. Collet member 48 holds object or bullet 14 in a lower section thereof for insert into matrix 46 within cup member 44. Cup member 44 is rotated about vertical axis line 24 and insert of bullet 14 must be substantially coincident with respect to the center line of the rotation of cup member 44 in order to eliminate wobble or other eccentrical displacements of object 14 when secured within matrix 46. Where any wobble or eccentric movement is evidenced as object 14 rotates, such will clearly cause displacement of the area being scanned and photographed and thus negate any meaningful comparisons between one bullet's striations 12 and the striations formed in a reference object or bullet 14.

Collet member or mechanism 48 is commonly referred to as a non-moving collet member which includes a spring-loaded collet section having finger holds 50 and an internally located collet spring 52. Bullet or object 14 may be inserted into collet member or mechanism 48 in a force contact mode whereby collet fingers 54 grasp the upper end of object 14. When collet 48 has been lowered into matrix 46 and the lower end of object 14 has been inserted into matrix 46, finger holds 50 are grasped and moved in a vertical direction to release object 14 from securement with collet mechanism 48. Once this has been completed, bullet or object 14 is secured within matrix 46 and may be rotated in unison with cup member 44.

In order to rotate the secured object 14 at a predetermined rotational speed about vertical axis line 24, there is provided cup shaft 56 extending through an opening in stationary table 26. Cup shaft 56 is coupled to motor 58 having attached encoder 60. Motor 58 and encoder 60 are commercially available from KOLLMORGEN MOTION TECHNOLOGIES GROUP, having a place of business in Radford, Va. and the motor/encoder combination is from the Platinum Series U9D. The function and operation of the encoder 60 which is integral with motor 58 will be described in following paragraphs. As will be described, motor/encoder 58/60 are in closed loop coupling with the remaining portions of striation monitor and display system 10 to provide motor control as to rotational speed of object or bullet 14 when mounted in matrix 46 during the overall monitoring and display procedure.

System 10 further includes a mechanism for photographing a plurality of images of the rotating object 14 along a vertical direction 24 at a predetermined image frame speed. In order to accomplish this photographing of a plurality of images, line scan camera 62 with associated camera lens 64 is aligned with object 14 encased in matrix 46. Alignment of line scan camera 62 is accomplished through an adjustment mechanism in vertical direction 24, and/or longitudinal direction 66 and/or lateral direction 68 through any one of a number of mechanisms, one of which being a screw table which may have mounted on it the line scan camera 62 and be threadedly moved in directions 24, 66 or 68 as is necessary to align lens 64 with a particular section of object 14. Line scan camera 62 is a commercially available line scan camera and is manufactured by DALSA INC. of Waterloo, Ontario, Canada, having a Model No. CLC41024N and CLC42048-A. Such line scan cameras are well known in the art and provide for the photographing of a vertical line image.

The particular line scan camera 62 being used has associated with it 1024 or 2048 pixels. Line scan camera 62 being mounted on the adjustable table mechanism allows for vertical, lateral and longitudinal displacement as has been described. Displacement in vertical direction 24 is important since the vertical displacement of the camera allows for capturing images in a particular vertical section of object or bullet 14. Longitudinal displacement in longitudinal direction 66 may be used for focusing line scan camera 62 at a particular section being photographed during rotation. Lateral displacement in direction 68 may be used in finding a position where light impingement on the outer surfaces of object 14 optimizes the images being photographed by line scan camera 62. In fact, displacement in lateral direction 68 may be provided out of line with the apex of the curvature of the object 14 with respect to line scan camera 62 in order to enhance the shadowing and striations 12 being photographed.

Figure 4:
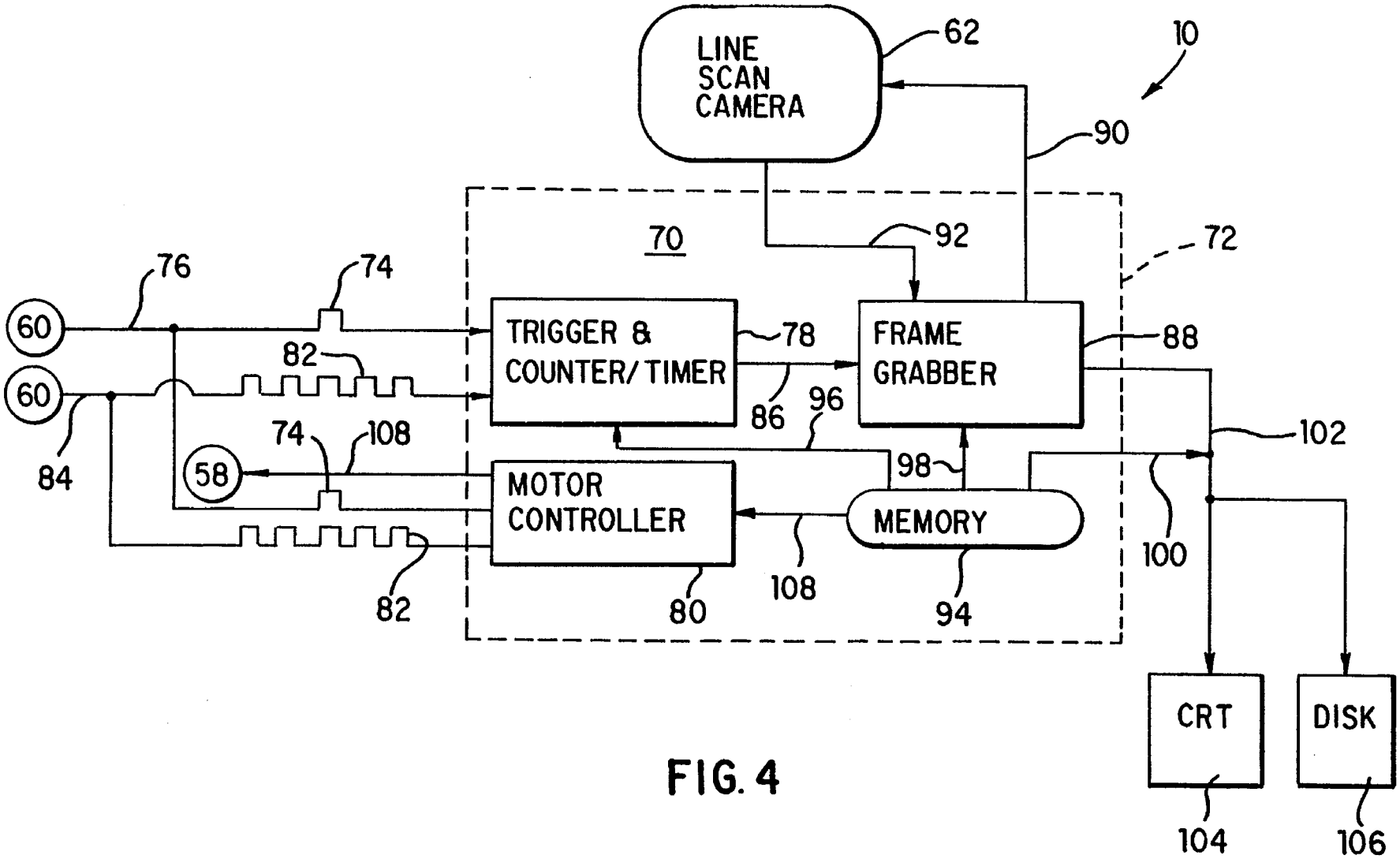
FIG. 4 is a circuit block diagram of the synchronization circuit coupling the rotational speed of the object and a line scan camera frame speed showing storage of photographed images in a disc or for display on a monitor; and, FIG. 5 is a schematic block diagram showing a linear translational mechanism for linearly driving a noncylindrical object to be photographed.

In order to synchronize the rotational speed of object 14 and image frame speed of line scan camera 62, synchronizing circuitry is provided in combination with processor 72 as is shown in FIG. 4. The object of synchronizing circuit 70 is to provide a closed feedback loop to motor and encoder combination 58, 60 and maintain a predetermined relation between positional points on object 14 and the images being photographed by line scan camera 62. Line scan camera 62 only captures one line at a time and does not contain memory. The external synchronizing system 70 essentially communicates with line scan camera 62 and triggers signals to take each of the lines which are going to form the overall image at the proper time.

In order for synchronization to be accomplished as shown in FIG. 4, encoder 60 provides index pulse 74 on encoder input line 76 to specify a particular position on the rotational surface of bullet 14 as being a zero or initial position. Index pulse 74 is generated once per revolution of object or bullet 14. The index pulse 74 is used as the initial or zero point to start a particular count. Index pulse 74 is input to trigger and counter/timer circuit 78 as well as motor controller circuit 80 to be further described in following paragraphs.

Encoder 60 further provides for a series of encoder pulses 82 on encoder second input line 84 which are similarly input to trigger and counter/timer circuit 78 as well as motor controller 80. Encoder pulses 82 are provided on second input line 84 in a predetermined number per a single rotation of bullet or object 14. In the subject system 10 being used 1200 encoder pulses 82 per single rotation are provided however, such may be increased, as for example, to 4800 encoder pulses 82 per rotation. Both index pulses 74 and encoder pulses 82 are inserted into trigger and counter/timer circuit 78 which is an I/O card manufactured by COMPUTER BOARDS, INC. of Mansfield, Mass., having a Model No. C10-D1024. The I/O card or trigger and counter/timer circuit 78 is commercially available and essentially provides for a count of encoder pulses 82 subsequent to the input of a particular index pulse 74. Encoder pulses 82 are counted and subsequent to counting up a preset number of encoder pulses 82, such generates a trigger signal on line 86. The signal passed on trigger and counter/timer output line 86 is input to frame grabber 88. Frame grabber 88 is a commercially available circuit manufactured by BITFLOW INC. of Woburn, Mass. and has a Model Designation No. Dataraptor PC1. The trigger signal passed from trigger and counter/timer circuit 78 on output line 86 provides for the actuation of the frame grabber's frame capture mechanism. the frame's maximum length may not span the entire circumference of object 14 and thus multiple frames must be tiled when the entire circumference is to be scanned. This is accomplished by computing the number of encoder pulses spanned by a current frame and adjusting the offset of a subsequent frame by that number of encoder pulses. The process is then iterated until the entire circumference has been tiled with successive portions of the image.

Frame grabber 88 upon reception of a signal on line 86 passes a signal on frame grabber output line 90 to line scan camera 62 for actuation thereof. The line images taken by line scan camera 62 are then passed to frame grabber 88 on line 92 as is shown. In essence, and as has been described, encoder pulses 82 inserted on line 84 are used to count a predetermined distance in rotation of object 14 from the occurrence of an index pulse 74 to provide successive frames of bullet or object 14.

In operation, I/O card or trigger and counter/timer circuit 78 is preset by a program in memory 94 which is inserted into block 78 on line 96. The preset number from memory 94 is used to count encoder pulses 82 which provides for a counting of each pulse 82 on line 84 and subsequent to counting down in block 78 to a zero position, the desired number of encoder pulses 82 provides for the rotation of motor 58 from the zero position. When I/O card 78 reaches zero, the signal is triggered on line 86 serving as the input to frame grabber 88. This signal is used to begin capturing a particular frame by line scan camera 62 as has been described. Memory 94 also inputs to frame grabber 88 the particular number of lines per frame and a line rate which is the number of lines for capturing per unit of time, such as per second. Input to frame grabber 88 is made on line 98 from memory 94. Once frame grabber 88 has been triggered from line 86 to begin a frame, pulses are sent over line 90 to line scan camera 62 and for each pulse sent over line 90, line scan camera 62 will capture the vertical line that it has been viewing and output that line back to frame grabber 88 on line 92.

Frame grabber 88 maintains this procedure for assembly of all lines into a frame of continuous lines until a maximum number of lines in the frame has been reached which is preset in program memory 94. At the time that the maximum number of lines has been reached, the frame is terminated. Program memory 94 then directs data to memory line 100 and a signal I/O output line 102 for insert into CRT 104 or disc 106 or alternatively to some other peripheral device for display, monitoring or storage.

Velocity of motor rotation is read back to motor controller card 80 on line 108 from memory 94 for maintenance of a particular rotational speed of motor 58. Motor controller card 80 is commercially available from TECHNOLOGY 80, INC. of Minneapolis, Minn. and has a Model Designation TE5638. Motor controller card 80 calculates the current velocity of motor 58 by signals received on lines 76 and 84 and based upon that input, generates a DC control voltage over line 108 to motor 58 to update the velocity. In this manner there is provided a closed loop control and the motor controller card or circuit 80 maintains a near constant rotational velocity of the motor output 58.

It is to be understood that the fragment of bullet or object 14 being imaged by line scan camera 62 may need external light impinging on the vertical line of data being captured by line scan camera 62. Light may be provided by an external light source (not shown) and through use of fiber optic cable with a focusing lens at the output would provide focused light on a desired vertical section of the object or bullet 14 being imaged. Through use of a fiber optic cable, there would be an optimization of space required near the object 14 since the light source would be remote from the light impinging on object 14 in the desired sectional area.

In some embodiments of system 10, a selectable image start function and even a motor controller may be coupled directly to line scan camera 62 for frame synchronization. Such options and embodiments for initiating a frame on the occurrence of a particular event such as a desired rotational position of motor 58 are well known in the art and may be employed in overall striation monitor and display system 10 as herein described.

System 10 thus provides a method of displaying and monitoring striations 12 formed within a generally cylindrically contoured object or bullet 14 and initially includes the step of positionally locating object 14. The step of positionally locating object 14 includes the step of releasably securing object 14 within collet member 48 having a collet axis line 24 coincident with a rotational axis line of object 14 during the procedure.

Once object 14 is positionally located, collet 48 is moved in vertical direction 24 to provide for capturing the positionally located object 14 within a releasable medium such as compliant matrix 46 contained within cup member 44. Object 14 is inserted within matrix 46 in order that striations 12 at the upper or back end portion of object 14 are visible.

Subsequent to capturing of the positionally located object 14, the object 14 is rotated about vertically extending axis line 24 at a predetermined rotational speed. The step of rotating object 14 includes the step of actuating motor 58 having a shaft 56 coupled to cup 44 with the motor having a predetermined rotational speed for responsively rotating object 14 secured within compliant matrix 46.

The step of rotating object 14 about axis line 24 is followed by the step of photographing a plurality of vertical line images of object 14 at a predetermined frame speed by line scan camera 62. The photographing of vertical section line images includes the step of aligning line scan camera 62 with object 14 where line scan camera 62 is focused to a section of object 14 being photographed.

Photographing of the plurality of vertical line images for display on a monitor or cathode ray tube 104 or for storage on disc 106 requires the step of synchronizing predetermined frame speeds of line scan camera 62 with the rotational speed of object 14. The step of synchronizing includes the step of encoding an index pulse 74 from encoder 60 integral with motor 58. Additionally, the synchronizing step further includes the encoding of a constant predetermined number of encoder pulses 82 for each rotation of object 14. The index pulses 74 and encoder pulses 82 are input to a trigger and counter/timer circuit 78 for triggering of a signal on line 86 to frame grabber or frame capture circuit 88 for actuation of line scan camera 62 at a predetermined positional location of object 14 as such is rotated.

Figure 5:
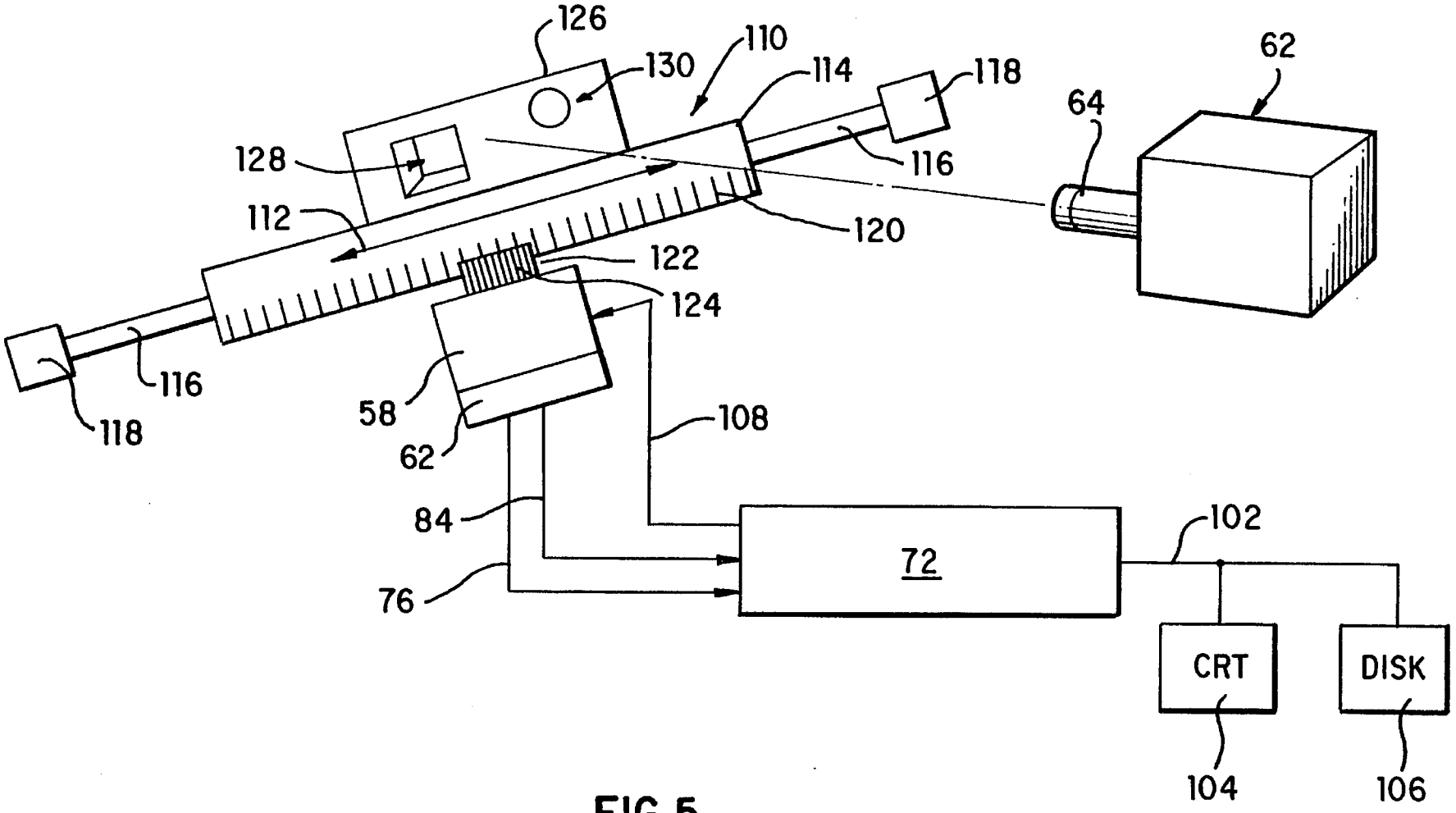

In some cases, bullets may break into pieces and only fragments of the bullet may be recovered after the bullet has impinged a target. In such cases, the bullets are somewhat shattered and are non-cylindrical in contour. Such object fragments cannot be held in collet 48 and obviously cannot be properly rotated in the line of sight of line scan camera 62. In order to accommodate non-cylindrically contoured objects 14, an embodiment to overall striation monitor and display system 10 is provided as shown in FIG. 5. The basic concept is similar to that shown in FIGS. 1–4 however, in the embodiment shown in FIG. 5 there is provided linear translation mechanism 110 which cooperates with motor 58 and encoder 62 to drive a captured object in a linear direction as shown by linear direction arrows 112.

As was the case in system 10 shown in FIGS. 1–4, the combined motor 58/encoder 62 is coupled to processor 72 through lines 76, 84 and 108 for providing necessary pulses to processor 72. Output of processor 72 is provided on line 102 for immediate display on cathode ray tube 104 or for storage on disc 106.

The difference between the embodiment shown in FIG. 5 and that provided in FIGS. 1–4 is generally directed to linear translation mechanism 110. Linear translation mechanism 110 includes rack member 114 which is slidingly displaced on rack rods 116 in reversible direction 112. Rack rods 116 include rack stop members 118 formed at opposing ends of rack rods 116 as shown.

Rack member 114 includes a plurality of rack gear teeth 120 formed on rack member 114 which meshingly engage motor gear teeth 122 formed on motor gear 124 which is secured to a shaft of motor 58. In this manner, rotative actuation of the shaft of motor 58 causes a responsive rotative displacement of motor gear 124 and the meshingly engaged motor gear teeth 122 and rack gear teeth 120 causes linear displacement of rack member 114 in reversible linear direction 112 as shown.

Attached to rack member 114 is object holding receptacle 126 which is fixedly secured to rack member 114 and responsively is driven in linear direction 112 as rack member 114 is displaced.

Object holding receptacle 126 includes fragment cup or receiving member 128 within which matrix 46 as previously described may be contained and whereby the object fragment may be releasably captured therein. Object holding receptacle 126 may also include cartridge receiving member 130 for insert of a used cartridge.

As rack member 114 is displaced by motor 58, object holding receptacle 126 is linearly translated in direction 112 and passes through the line of sight of line scan camera 62.

In this embodiment shown in FIG. 5, synchronization is obviously directed to the synchronization of the linear translation speed of the objects being held in fragment cup or receiving member 128 and cartridge receiving member 130 with respect to the frame speed of line scan camera 62. The trigger and counter/timer 78, frame grabber 88, motor controller 80 and memory 94 as shown in FIG. 4 act in substantially the same manner for the embodiment of FIG. 5 in overall concept. Object holding receptacle 126 is mounted on rack member 114 and holds the objects to be photographed at approximately the correct height and correct nominal distance from camera 62 and associated lens 64. For rack scanning operations, the motion profile of motor 58 is a linear translation instead of a continuous rotation as was described for FIGS. 1–4. However, accommodation of the linear translation is made through motor controller 80 and memory 94 of processor 72.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A striation monitor and display system comprising:

(a) means for releasably capturing a substantially cylindrically contoured object;

(b) means for positionally locating said object, said positionally locating means including a stationary table and an object placement fixture for positionally fixing and securing said object to said releasable capturing means, said object placement fixture including (a) means for releasably securing said object to said object placement fixture, and (b) means for vertically displacing said releasably secured object to said means for releasably capturing said object;

(c) means for rotating said object at a predetermined rotational speed about a vertically extending axis line of said object;

(d) means for photographing a plurality of images of said rotating object along a vertical direction at a predetermined image frame speed;

(e) means for synchronizing said predetermined object rotation with said image photographing means; and, (f) means for displaying said photographed object.

2. The striation monitor and display system as recited in claim 1 where said means for releasably securing said object includes a collet member for releasably holding said object therein.

3. The striation monitor and display system as recited in claim 2 where said means for vertically displacing said object includes:

(a) a fixture lower base member secured to said stationary table;

(b) a fixture upper base member having said collet member fixedly secured on one end thereof; and, (c) means for vertically displacing said fixture upper base member with respect to said fixture lower base member.

4. The striation monitor and display system as recited in claim 3 where said means for vertically displacing said fixture upper base member includes:

(a) a pair of vertically directed fixture rods secured to said fixture lower base member, said fixture upper base member being slidable on said fixture rods; and, (b) means for vertically biasing said fixture upper base member from said fixture lower base member.

5. The striation monitor and display system as recited in claim 4 where said means for vertically biasing includes at least one spring member sandwiched between said fixture lower base member and said fixture upper base member.

6. The striation monitor and display system as recited in claim 5 including stop means for establishing a minimum displacement distance between said fixture lower base member and said fixture upper base member.

7. The striation monitor and display system as recited in claim 6 where said stop means includes a stop rod member threadedly secured to and passing through said fixture upper base member for contacting an upper surface of said fixture lower base member.

8. A striation monitor and display system comprising:

(a) means for releasably capturing a substantially cylindrically contoured object, said means for releasably capturing said object including a cup member rotatably displaceable with respect to a vertically directed axis and a compliant medium within said cup member for at least partial insert of said object;

(b) means for positionally locating said object, said positionally locating means including a stationary table and an object placement fixture for positionally fixing and securing said object to said releasable capturing means;

(c) means for rotating said object at a predetermined rotational speed about said vertically directed axis;

(d) means for photographing a plurality of images of said rotating object along a vertical direction at a predetermined image frame speed;

(e) means for synchronizing said predetermined object rotation with said image photographing means; and, (f) means for displaying said photographed object.

9. The striation monitor and display system as recited in claim 8 where said compliant medium is beeswax.

10. The striation monitor and display system as recited in claim 8 where said means for rotating said object includes motor means coupled to said means for releasably capturing said object.

11. The striation monitor and display system as recited in claim 10 where said means for synchronizing said predetermined object rotation, angular position and said image frame speed and frame start position includes:

(a) encoder means coupled to said motor means for producing an index signal and a plurality of rotational signals for each rotation of said object; and, (b) trigger means coupled to said encoder means for receiving said index and rotational signals and outputting a trigger signal for capturing a frame image of said object.

12. The striation monitor and display system as recited in claim 11 where said trigger means includes frame capture means for receipt of said trigger signal, said frame capture means for outputting a line scan camera actuating signal and an output signal to said display means.

13. The striation monitor and display system as recited in claim 12 where said frame capture means is coupled to memory means for determining a number of frame lines to be displayed.

14. The striation monitor and display system as recited in claim 13 including motor control means coupled to said encoder means and said memory means for maintaining a substantially constant rotational velocity of said rotating object.

15. The striation monitor and display system as recited in claim 13 where said means for displaying includes a CRT monitor coupled to said frame capture means.

16. The striation monitor and display system as recited in claim 13 where said means for displaying includes a disc member coupled to said frame capture means.

17. The striation monitor and display system as recited in claim 8 where said means for photographing includes a line scan camera for producing a line image along said vertically extending axis line of said object.

18. The striation monitor and display system as recited in claim 17 including means for adjustably displacing said line scan camera in a longitudinal, lateral and said vertical direction for focusing said line scan camera on said vertically extending axis line of said object.

19. A method of displaying and monitoring striations formed in a generally cylindrically contoured object including the steps of:

(a) positionally locating said object;

(b) capturing said positionally located object within a releasable medium, said step of capturing including the step of inserting at least a portion of said object into a compliant matrix;

(c) rotating said object about a vertically extending axis line of said object at a predetermined rotational speed;

(d) photographing a plurality of vertical line images of said object at a predetermined frame speed;

(e) synchronizing said predetermined frame speed to said object rotational speed; and, (f) displaying said photographed object.

20. The method of displaying and monitoring striations as recited in claim 19 where the step positionally locating said object includes the step of releasably securing said object to a collet member having a collet axis line coincident with a rotational axis line of said object.

21. The method of displaying and monitoring striations as recited in claim 19 where the step of rotating said object includes the step of actuating a motor coupled to said object and having a predetermined rotation speed for responsively rotating said object secured within said compliant matrix.

22. The method of displaying and monitoring striations as recited in claim 19 where the step of photographing includes the step of imaging a vertical section of said object.

23. The method of displaying and monitoring striations as recited in claim 22 where the step of imaging includes the step of aligning a line scan camera with said object being imaged.

24. The method of displaying and monitoring striations as recited in claim 23 where the step of aligning includes the step of focusing said line scan camera to a section of said object being photographed.

25. The method of displaying and monitoring striations as recited in claim 22 where the step of synchronizing includes the step of encoding an index pulse for each rotation of said object.

26. The method of displaying and monitoring striations as recited in claim 25 where the step of synchronizing further includes the step of encoding a constant predetermined number of encoder pulses for each rotation of said object.

27. The method of displaying and monitoring striations as recited in claim 26 where the step of encoding a constant predetermined number of encoder pulses includes the step of actuating said line scan camera at a time coinciding with a particular one of said encoder pulses being encoded.

28. A striation monitor and display system comprising:

(a) means for releasably capturing an object, said means for releasably capturing including a compliant medium for at least partial insert of said object;

(b) means for linearly translating said captured object;

(c) means for photographing a plurality of images of said object being linearly translated;

(d) means for synchronizing a linear translation speed of said object with said photographing means; and, (e) means for displaying said photographed object.

29. The striation monitor and display system as recited in claim 28 where said means for linearly translating said object includes:

(a) motor means:

(b) rack means coupled to said motor means for displacing said object in a linear displacement.

30. The striation and monitor and display system as recited in claim 29 where said motor means includes a motor gear member having motor gear teeth rotatively actuated responsive to a rotative displacement of a motor shaft of said motor means.

31. The striation monitor and display system as recited in claim 30 where said motor gear teeth meshingly engage a set of rack teeth formed on said rack means for transforming a rotative displacement of said motor means shaft to a linear displacement of said rack means.

32. The striation monitor and display system as recited in claim 28 where said means for releasably capturing said object includes an object holding receptacle fixedly secured to said means for linearly translating said captured object and containing said compliant medium therein.

* * * * *